US005992513A

United States Patent [19]

Suzuki et al.

[11] Patent Number: 5,992,513

[45] Date of Patent: Nov. 30, 1999

[54] INNER SURFACE GROOVED HEAT TRANSFER TUBE

[75] Inventors: Yoshio Suzuki; Kenichi Inui; Masakazu Tobe; Tadao Otani, all of Ibaraki, Japan

[73] Assignee: Hitachi Cable, Ltd., Tokyo, Japan

[21] Appl. No.: 09/065,580

[22] Filed: Apr. 24, 1998

[30] Foreign Application Priority Data

Sep. 17, 1997 [JP] Japan ..... 9-251836

[51] Int. Cl.[6] ..... F28F 1/40

[52] U.S. Cl. ..... 165/133; 165/184

[58] Field of Search ..... 165/133, 179, 165/184

[56] References Cited

U.S. PATENT DOCUMENTS

| | | | |
|---|---|---|---|
| 4,480,684 | 11/1984 | Onishi et al. | 165/133 X |
| 4,733,698 | 3/1988 | Sato | 165/179 X |
| 5,332,034 | 7/1994 | Chiang et al. | 165/184 |
| 5,458,191 | 10/1995 | Chiang et al. | 165/133 |

FOREIGN PATENT DOCUMENTS

| | | | |
|---|---|---|---|
| 116765 | 9/1979 | Japan | 165/133 |
| 56-59194 | 5/1981 | Japan . | |
| 57-58092 | 4/1982 | Japan . | |
| 119192 | 7/1984 | Japan | 165/184 |
| 60-29593 | 2/1985 | Japan . | |
| 175485 | 8/1986 | Japan | 165/184 |
| 37693 | 2/1987 | Japan | 165/133 |
| 237295 | 10/1987 | Japan | 165/184 |
| 44165 | 2/1990 | Japan | 165/184 |
| 8-61878 | 3/1996 | Japan . | |
| 8-178574 | 7/1996 | Japan . | |

*Primary Examiner*—Leonard Leo
*Attorney, Agent, or Firm*—McDermott, Will & Emery

[57] ABSTRACT

In an inner surface-grooved heat transfer tube, a plurality of fins is formed on the inner surface thereof along a line forming a first predetermined angle with respect to the longitudinal axis of the tube, a plurality of notches is defined on the fins along a line forming a second predetermined angle with respect to the longitudinal axis, and the depth Hf' of the notches is specified to be 20% or more and below 40% ($0.2 \leqq Hf'/Hf < 0.4$) with respect to the height Hf of the fins, to provide an inner surface-grooved heat transfer tube which can suppress pressure loss of a refrigerant, and by which improvements in performance of condensation and evaporation are intended. In addition no increase of power consumption is required for the pump.

11 Claims, 4 Drawing Sheets

10 : A SYSTEM FOR MEASURING HEAT TRANSFER PERFORMANCE
11 : COMPRESSOR
12 ~ 19 VALVE
20 : MEASURING REGION
21 : HEAT TRANSFER TUBE
22 : INLET/OUTLET
23 : WARM/COOLING WATER SUPPLY
24 : RECEIVER
25 : DRYER
26 : SUBCOOLER
27 : FLOWMETER
28 : EXPANSION VALVE
29 : EVAPORATOR
30 : CONDENSER

INNER SURFACE GROOVED HEAT TRANSFER TUBE

FIELD OF THE INVENTION

The present invention relates to inner surface-grooved heat transfer tubes; in particular, to inner surface-grooved heat transfer tubes with excellent performance in evaporation and condensation of refrigerant plus the additional benefit of low pressure loss.

BACKGROUND OF INVENTION

In heat exchangers such as air conditioners, refrigerators, etc., heat transfer tube is employed to convey a refrigerant which changes its phase between liquid and gas to create an exchange of heat relative to any fluid outside the tube. Continuous spiral grooves defined on the inner surface of the tube in, for example, a heat exchanger such as a room air conditioner promote the thermal conduction from the evaporation and condensation process in the tube. The continuous spiral grooves act to increase the heat transfer area, and the turbulent refrigerant elevates heat transfer rate. A cross grooved heat transfer tube is also available wherein two types of grooves set at different angles to each other with respect to the longitudinal axis are added. This intensifies fluid turbulence to improve the heat transfer properties.

Heat transfer tubes based on this cross grooved principle are described in, for example, Japanese Patent Application Laid-Open Nos. Sho 57-58092, Sho 60-29593, Hei 6-221788, Hei 8-42987, Hei 8-61878, Hei 8-178547, Hei 8-42978, and Sho 56-59194.

Among them, cross grooved heat transfer tube (hereinafter referred to as "the first inner surface-grooved heat transfer tube") as described in Japanese Patent Application Laid-Open No. Sho 57-58092 is constituted as having primary and secondary grooves rotating in opposite directions to each other defined on the inner wall surface thereof, with the secondary grooves shallower than the primary grooves. This means that a liquid film produced on the surfaces of protuberances (fins) forming on the primary grooves will drop to the bottom of the tube due to gravity all the while flowing over primary and secondary grooves by surface tension. Improvement in the heat transfer rate through condensation is intended.

A cross grooved heat transfer tube (hereinafter referred to as "a second inner surface-grooved heat transfer tube") described in Japanese Patent Application Laid-Open No. Sho 60-29593 is a tube wherein ribs (fins) are formed by defining the first grooves each of which has a predetermined angle with respect to the longitudinal axis of the tube, and on which the secondary grooves being shallower than the primary grooves are defined on the ribs at a predetermined angle with respect to the longitudinal axis going around towards the direction opposite to the primary grooves. Improvement in the heat transfer performance of single phase flow is intended on the basis of the above described constitution.

A cross grooved heat transfer tube (hereinafter referred to as "a third inner surface-grooved heat transfer tube") disclosed in Japanese Patent Application Laid-Open No. Hei 5-221788 is a tube wherein a plurality of fins substantially parallel to the longitudinal direction of the tube are provided on the inside wall of the tube so that primary grooves are constituted between each two fins and spiral notches are defined on the same fins at a predetermined angle with respect to the longitudinal axis of the tube. These notches constitute secondary grooves. This heat transfer tube is manufactured in a manner where a strip of copper or a copper alloy is rolled to form the fins. Notches are then defined by rolling and embossing the same with accompanying formation of burr. Finally the materials thus processed, are subjected to seam welding to obtain a tubular structure. In this heat transfer tube, improvement in heat transfer performance is intended by specifying the depth of the notches to be at least 40% of the height of the fins.

A cross grooved heat transfer tube (hereinafter referred to as "a fourth inner surface-grooved heat transfer tube") disclosed in Japanese Patent Application Laid-Open No. Hei 8-178574 is a tube wherein main grooves intersecting subsidiary grooves are provided on the inside of the tube, and three-dimensional projections involving burr in the front and rear thereof are formed on the fins constituting the main grooves.

A cross grooved heat transfer tube (hereinafter referred to as "a fifth inner surface-grooved heat transfer tube") disclosed in Japanese Patent Application Laid-Open No. Hei 8-42987 is a tube wherein fins are formed on the inside of the tube, and notches to interrupt the fins at predetermined pitches, respectively, are defined on the fins.

A cross grooved heat transfer tube (hereinafter referred to as "a sixth inner surface-grooved heat transfer tube") disclosed in Japanese Patent Application Laid-Open No. Hei 8-61878 is a tube wherein the depth of the notches has been increased to define grooves on the inner surface of the tube in the cross grooved heat transfer tube as disclosed in Japanese Patent Application Laid-Open No. Hei 8-42987.

A cross grooved heat transfer tube (hereinafter referred to as "a seventh inner surface-grooved heat transfer tube") disclosed in Japanese Patent Application Laid-Open No. Sho 56-59194 is a tube wherein fins involving notches defined thereon at a predetermined gap, are formed on the inside of the tube, and concave portions communicating with the inner space of the tube through fine openings are defined under the grooves defined between each two fins.

A heat exchanger utilized as in air conditioners, refrigerators or the like requires a condenser in which the fluid flowing through the interior of a tube will change from gas to liquid, and an evaporator in which the fluid will change from liquid to gas. Since condensers and evaporators are optimized to be in accordance with the environments to which they are applied, no sufficient performance is obtained in other environments. In this respect, the use of the heat transfer tube depends on the suitability of the condenser and evaporator to be applied.

In recent years, overcoming environmental problems such as global warming, the depletion of the ozone layer, acid-rain, and pollution of the oceans has become a significant challenge. One restriction is the use of CFCs as these deplete the ozone layer. 99.5% CFC-R22 (HCFC-22) which has until now been employed as a refrigerant for air conditioners will be also banned in 2020. The use of CFC-R22 has already been decreased. The selection of R407C for use in packaged air conditioners and R410A for use in room air conditioners is decisive.

The new refrigerants are mixed refrigerants of two or three types. R407C is a refrigerant prepared from three CFCs R32, R125, and R134a so as to achieve substantially the same physical properties as those in currently used R22 wherein respective refrigerants evaporate and condense at different temperatures to one another. The resulting R407C is referred to as a zeotropic mixed refrigerant. On the other hand, R410A is a refrigerant prepared by mixing R32 with R125 at a ratio of 1:1. The refrigerant exhibits a substantially azeotropic state, so there is no decrease in heat transfer performance, but its operating pressure is about 1.6 times higher than that of R22. In these circumstances, the heat transfer tube is used for both condensation and evaporation, so it requires a different constitution from that of conventional heat transfer tubes.

However, in accordance with the conditions outlined in the descriptions in the conventional first to seventh inner surface-grooved heat transfer tube patents, if the depth of the secondary grooves defined on the fins forming the primary grooves is not suitable, pressure loss in the refrigerant will increase with subsequent loss in performance of condensation and evaporation.

At the same time, an increase in pump power consumption to prevent boundary formation between the gas and liquid constituting the zeotropic mixed refrigerant is undesirable.

On top of this, in accordance with the third and fourth inner surface-grooved heat transfer tubes descriptions where the depth of the secondary grooves is specified to be at least 40% of a height of the fins, burr produced at the time of forming the secondary grooves leads to greater pressure loss.

SUMMARY OF THE INVENTION

Accordingly, the object of the present invention is to provide an inner surface-grooved heat transfer tube which will suppress pressure loss of the refrigerant while providing improvement in performance of condensation and evaporation. This involves no increase in pump power consumption.

This inner surface-grooved heat transfer tube is comprised of:

A plurality of fins provided on the inner surface, each of which is defined at a predetermined angle relative to a tube axis, with each adjacent two sets of the aforesaid plurality of fins providing a primary groove.

A plurality of notches is also provided on the plurality of fins, each of which is defined at a second predetermined angle relative to the aforesaid tube axis; Wherein each said plurality of notches has a depth equal to 20% or more and below 40% ($0.2 \leqq Hf'/Hf < 0.4$)of the height of the aforesaid plurality of fins.

In accordance with the inner surface-grooved heat transfer tube of the invention, cross grooves composed of primary grooves formed between adjacent fins and secondary grooves formed by notches defined on the fins are provided on the inner surface of the tube. In addition, the depth of the notches is optimized, and hence, turbulence and rising of the refrigerant are promoted. Both good evaporation and good condensation performance are obtained by disturbing the boundary layer existing between the gas and liquid phase in a zeotropic mixture refrigerant such as R407C as a result of the turbulence effect. Furthermore, since the depth of notches as defined on the fins is specified to be from 20% or more to 40% or less ($0.2 \leqq Hf'/Hf < 0.4$)with respect to a height of the fin, burr which would be produced if notches on the fin were present and which would extend into the primary groove are reduced with the beneficial result that it becomes possible to keep pressure loss at a low level while maintaining active turbulence.

BRIEF DESCRIPTION OF THE DRAWINGS

The invention will be explained in more detail in conjunction with the appended drawings, wherein.

DESCRIPTION OF THE PREFERRED EMBODIMENTS

Before explaining the inner surface-grooved heat transfer tube in a preferred embodiment according to the invention, one of the aforementioned conventional inner surface-grooved heat transfer tube will be explained as in FIG. 1.

Figure 1:
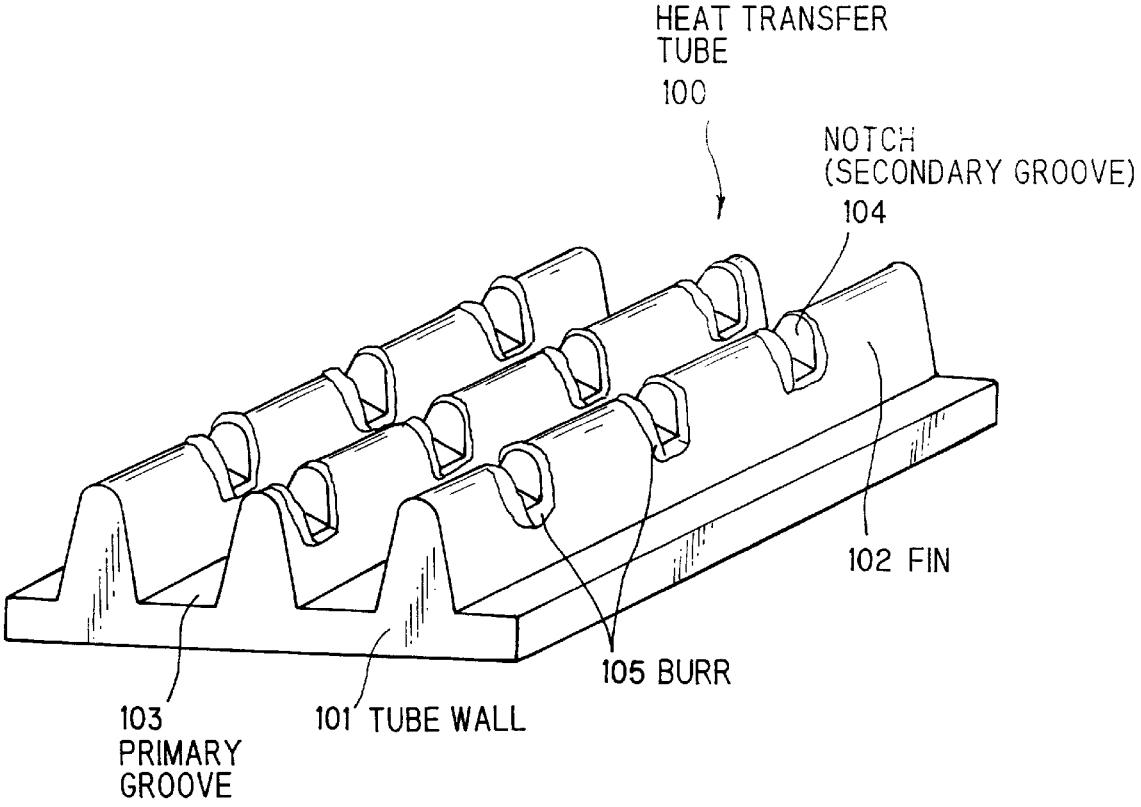
FIG.1 PRIOR ART
FIG. 1 is a perspective view showing an example of the inside of a conventional cross grooved heat transfer tube.

FIG. 1 shows a cross grooved heat transfer tube, i.e., the third inner surface-grooved heat transfer tube disclosed in Japanese Patent Application Laid-Open No. Hei 5-221788 wherein a plurality of fins 102 being substantially parallel to the longitudinal direction of the heat transfer tube 100 are formed on the inner surface of a tube wall 101 thereof, and each of the primary grooves 103 are defined between these adjacent fins 102, while notches 104 are defined on each of the fins 102 at a predetermined angle with respect to the longitudinal axis of the tube to form spiral secondary grooves. This heat transfer tube 100 is manufactured in a manner where a copper or copper alloy strip is rolled to form the fins 102, and, the notches 104 are defined by rolling and embossing the fins 102. This is accompanied with formation of burr 105 in the notches. Finally these resulting rolled strips are subjected to seam welding to form a tubular product. In this heat transfer tube 100, the depth of each notch 104 is made to be at least 40% with respect to the height of each fin 102, with the intention to improve the heat transfer performance thereof.

Next, an inner surface-grooved heat transfer tube in a preferred embodiment according to the invention will be explained as in FIG. 2.

Figure 2:
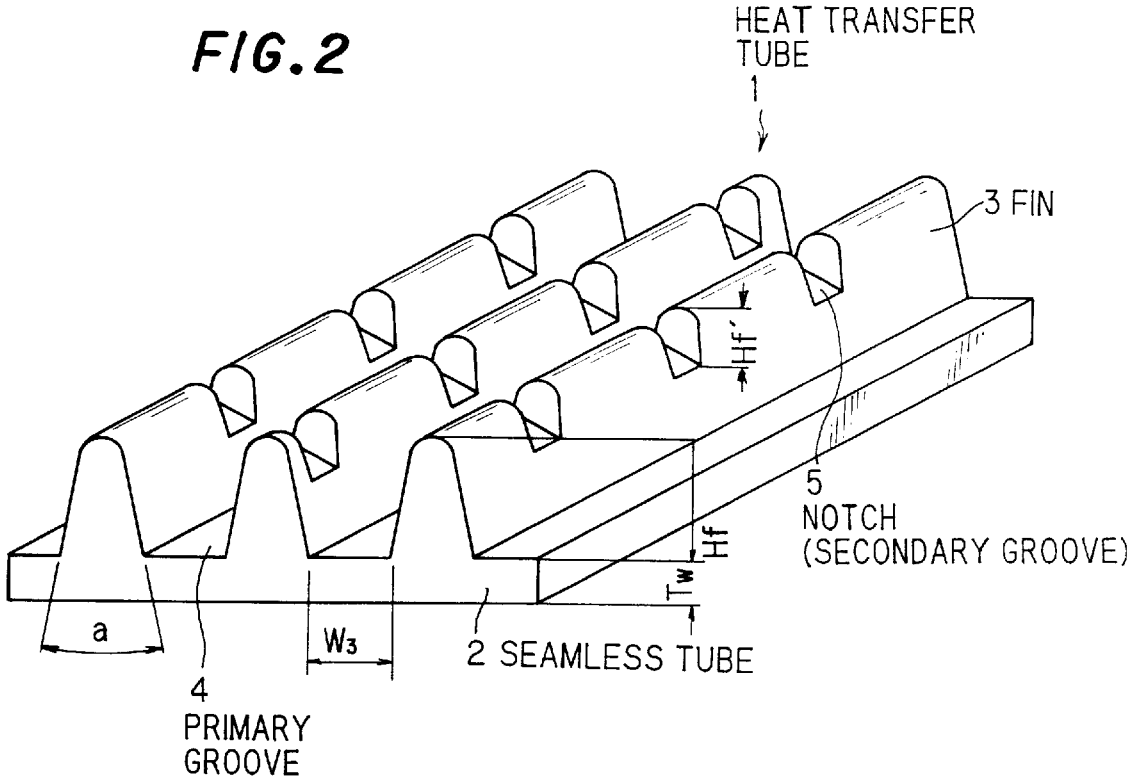
FIG. 2 is a perspective view showing the enlarged inside of an inner surface-grooved heat transfer tube according to an embodiment of the invention.

FIG. 2 illustrates an inner surface-grooved heat transfer tube in accordance with the embodiment of the present invention wherein a part of the inner surface thereof is enlarged. The heat transfer tube 1 is manufactured in such a manner that a plurality of continuous fins 3 each having a predetermined angle with respect to the longitudinal axis of the tube are formed on the inner surface of a seamless tube 2 made of, for example, copper or a copper alloy, whereby each of continuous primary grooves 4 is defined between these adjacent fins 3. Furthermore, a plurality of notches 5 is defined on each of the fins 3 along lines each of which has an angle with respect to the longitudinal axis of the tube which is an acute angle with respect to the longitudinal axis towards the direction opposite to the former predetermined angle, whereby these notches 5 defined on the fins 3 form secondary grooves, so that a cross grooved structure involving these primary grooves 4 and secondary grooves 5 is obtained.

In this case, it is preferred that a height Hf of the fin 3 is usually within a range of from 0.18 mm to 0.3 mm. When the height of the fin 3 is less than 0.18 mm, there is a case where heat transfer properties become poor although pressure loss decreases. On the other hand, when the height Hf of the fin exceeds 0.3 mm, there is a case where it becomes difficult to form the fins 3 on the inner surface of a seamless tube having an outside diameter of 6 mm or less, and thus it becomes difficult to stably supply the products from the industrial point of view. Furthermore, it is preferable that the cone angle a of the fin 3 be from 12 to 25 degrees, the ratio of the width w3 of the primary groove 4 to the outside diameter of the tube is made to be from around 0.017 to 0.049, and the ratio of the thickness Tw of the heat transfer tube 1 to the outside diameter of the tube is from around 0.027 to 0.052.

It is required that the depth of Hf' of the notch 5 defined on the fin 3 is 20% or more and below 40% ($0.2 \leqq Hf'/Hf < 0.4$)with respect to the height Hf of the fin 3. When the depth Hf' of the notch 5 is 20% or less ($Hf'/Hf < 0.2$)with respect to the height Hf of the fin 3, no advantage of increase in performance is obtained because of the decrease in turbulence effect. When it exceeds 40% ($Hf'/Hf \leqq 0.4$), burr (not shown) protruding inside the primary groove 4 in the case of defining the notch 5 on the fin 3 become more pronounced, so that the increase in pressure loss due to the burr produced becomes excessive, and as a result, the tube becomes unsuitable for employment in heat exchangers. In addition, when the depth of the notch 5 increases, its heat transfer area decreases, so that the performance decreases synthetically since there is reduction of performance due to decrease in the heat transfer area, even though there are improvements in performance due to the turbulence effect. It is to be noted that the contours of the notch 5 are not specifically limited, and although the notch 5 shown in FIG. 2 has a contour, the bottom of which is flat and the inclined side walls extend from the bottom with a slightly tapered surface, other contours such as U- and V-shaped contour may also be used.

Figure 3:
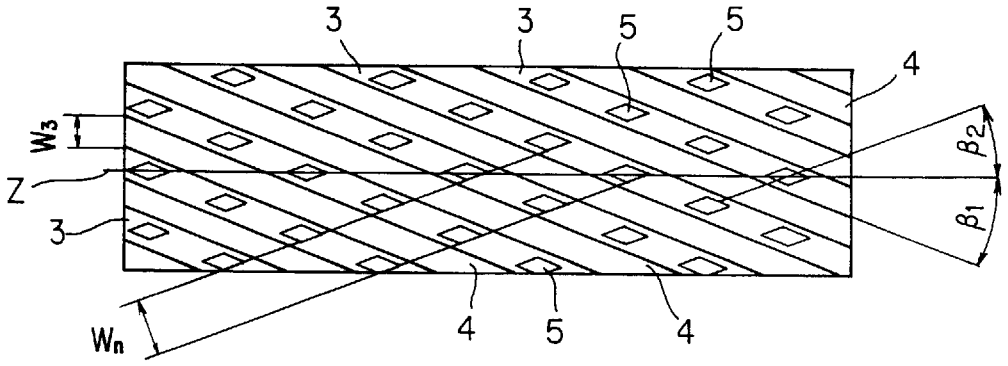
FIG. 3 is a plan view showing the developed inside of the inner surface-grooved heat transfer tube shown in FIG. 2.

FIG. 3 shows the angles of the fin 3 and the notch 5 shown in FIG. 2 with respect to the longitudinal axis of the tube, respectively, wherein the line situated on the central portion in FIG. 3 indicates the longitudinal axis z of the tube. The angle β1 of the fin 3 with respect to the longitudinal axis z may be from around 0°, i.e., parallel to the longitudinal axis z to 30°. It is particularly preferable that the angle β1 be within a range of from 10° to 23°.

On one hand, an angle β2 of the notch 5 with respect to the longitudinal axis z of the tube, which is an acute angle with respect to the longitudinal axis towards the direction opposite to the angle β1 of the fin 3, is, for example, from 0° to 10°, and particularly from around 0° to 5° is preferable. This arrangement wherein the angle β2 of the the notch 5 is opposed to the angle β1 of the fin 3 with respect to the longitudinal axis z is in such a manner that the direction of the notch 5 crosses that of the fin 3 to promote turbulence and raises the refrigerant thereby improving the heat transfre rate. The number of notches 5 may be from around 28 to 40 per cross section of the tube. When the number of notches is less than 28, improvements in performance due to the turbulence effect are slight, so that there is a case where advantages derived from provision of notches become low, while when the number of notches 5 exceeds 40, pressure loss due to increase of the notches 5 increases, so that there is a case where such heat transfer tube becomes substantially unsuitable for use in heat exchangers. In addition, as there is a case where the heat transfer area decreases with increase in notches, improvements in performance derived from turbulence effect, advantages in provision of the notches 5 are not synthetically obtained because of the subsequent decrease in performance due to the reduction of the heat transfer area. A ratio of a pitch Wn of the notches 5 to the outside diameter of the tube has around from 0.06 to 0.11.

As in the heat transfer tubes of the prior art as disclosed in Japanese Patent Application Laid-Open Nos. Sho 57-58092, Hei 6-221788, Hei 8-42987, and Hei 8-61878, respectively, even if the secondary groove is shallow with respect to the primary groove, the resulting pressure loss becomes more remarkable than any improvement in performance that would depend on the degree of shallowness. In the present invention, since the depth of the secondary groove is specified to be 20% or more and below 40% ($0.2 \leqq Hf'/Hf < 0.4$) with respect to the primary groove, good heat transfer performance can be consistent with low pressure loss.

According to the inner surface-grooved heat transfer tube in the embodiment of the invention, turbulence and raising the refrigerant are promoted, so the heat transfer rate due to the turbulence effect is elevated thanks to the presence of the cross grooves composed of the primary grooves defined between adjacent spirally continued fins, respectively, and the secondary grooves formed by the notches defined on the fins along a line forming a different angle from that of the aforesaid fin with respect to the longitudinal axis of the tube, respectively, and that the depth of such notches is optimized. When a zeotropic refrigerant such as R407C is employed in an evaporator or a condenser in which liquid and gas are in a mixed state, a boundary layer forms between the liquid and the gas, and further to this, if it is formed between gases having different components, heat transfer will be adversely affected by decreased performance. The heat transfer tube described in the present invention has the advantage that refrigerants as described above for improving heat transfer performance by disturbing the boundary layer due to turbulence effect, can be accommodated.

Furthermore, since the depth of the notches defined on the fins is specified to be 20% or more and below 40% ($0.2 \leqq Hf'/Hf < 0.4$) with respect to a height of the fins, it is possible to keep the pressure loss low while maintaining affective turbulence.

Moreover, since a seamless tube is used in the heat transfer tube according to the present embodiment of the invention, no welding is required for the overall length of tube, so no problem of weld strength is introduced. One heat transfer tube as disclosed in Japanese Patent Application Laid-Open Nos. Hei 6-221788, Hei 8-42987, Hei 8-61878 and the like, respectively, which does involve manufacture by seam welding after rolling and an embossing treatment, displays a problem of weld strength. That there is no assurance that the welded region has sufficient strength over the overall length of the tube, is a worry. A problem could arise in the case of employing R410A, as the working pressure of this is high.

A seamless inner surface-grooved heat transfer tube provided with fins and notches according to the present invention may be manufactured by a manner such as, for instance, a forward plug for forming fins and a rearward plug for forming notches are placed inside the metal tube, and the metal tube is rolled while pressing the same by means of a plurality of rolls which are disposed with respect to each of the aforesaid plugs from the outer surface of the metal tube. Fins are first formed on the inner surface of the metal tube, and then notches are defined on the fins, respectively. In this case, when the notches are defined on the fins, burr are produced, but as the depth of the notches is specified to be 20% or more and below 40% ($0.2 \leqq Hf'/Hf < 0.4$) with respect to a height of the fin in the present invention, increase in pressure loss due to burr is suppressed.

While a seamless tube has been employed for the heat transfer tube in the above described embodiment, the present invention includes also a heat transfer tube containing a welded seam manufactured by a seam-welding process.

In the following, an experiment wherein the relationship between the ratio of defining notches and performance of the inner surface-grooved heat transfer tube according to the present invention is determined will be described.

The inner surface-grooved heat transfer tube used in this experiment is 0.25 mm for the height Hf of the fin, 18° for the angle β1 of the fin 3 formed with respect to the longitudinal axis of the tube, 0.09 mm for the depth Hf' of the notch, 3.0° for the angle β2 formed with respect to the longitudinal axis of the tube towards the direction opposite to that of the fin, 6.48 mm for the inside diameter of the tube, 0.20 mm for the width W3 of the first groove, and 30/round for the number of notches per cross section of the tube, respectively.

Figure 4:
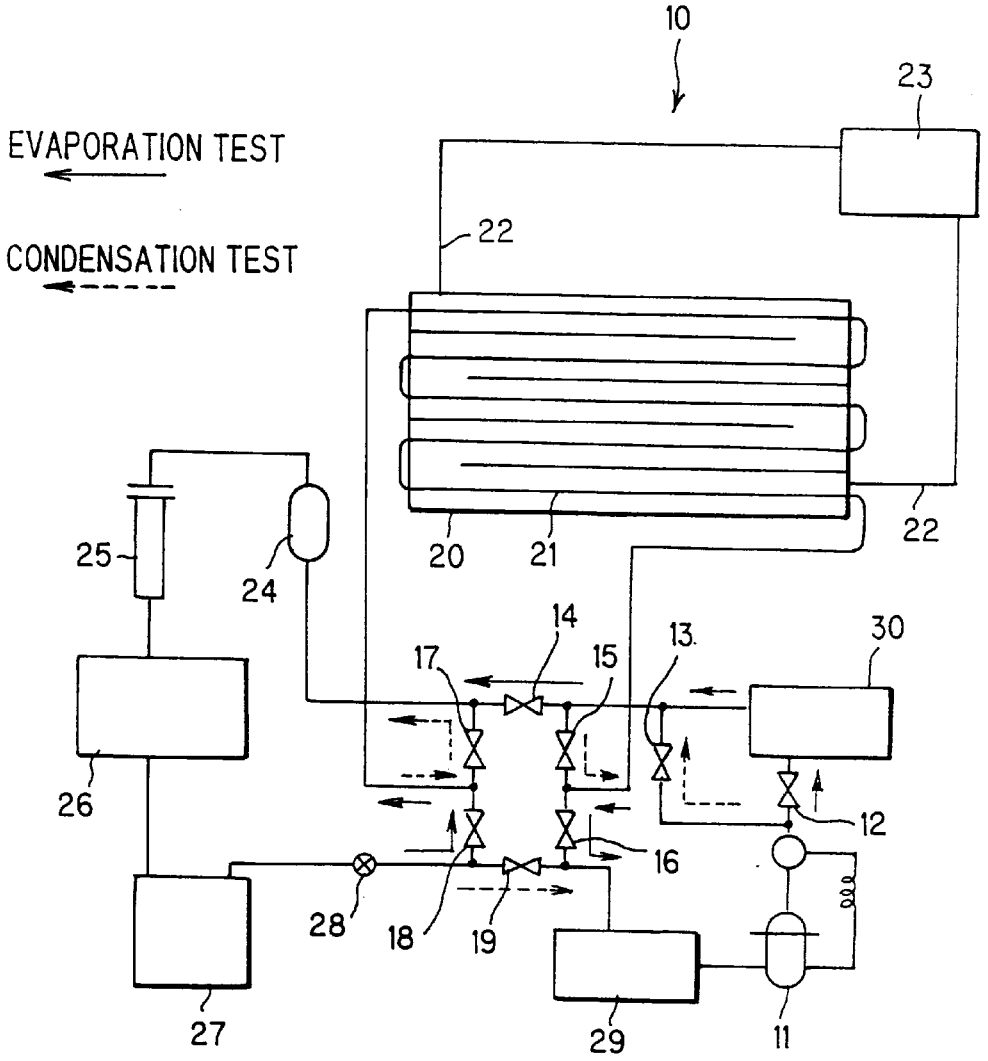
FIG. 4 is a performance-measuring system diagram showing a system used for measuring performance of a heat transfer tube in an experimental example.

A system 10 for measuring heat transfer performance shown in FIG. 4 was employed. In the system, valves 12, 13, 14, 15, 16, 17, 18, and 19 are utilized for switching circuits in the case when condensation performance and evaporation performance are measured, respectively. In the case of measuring condensation performance, the valves 13, 15, 17, and 19 are opened, while the valves 12, 14, 16, and 18 are closed. A refrigerant departed from a compressor 11 enters a heat transfer tube 21 placed in a performance-measuring region 20 in the form of gas through the valves 13 and 15 along the arrows indicated by each broken line. The refrigerant is condensed inside the heat transfer tube 21, the refrigerant thus condensed moves into an evaporator 29 through the valve 17, a receiver 24, a dryer 25, a subcooler 26, a flowmeter 27, an expansion valve 28, and the valve 19. The refrigerant changes again into gas in the evaporator 29, and the gaseous refrigerant returns to the compressor 11. In the case of measuring the evaporation performance, the valves 12, 14, 16, and 18 are opened, while the valves 13, 15, 17, and 19 are closed. The refrigerant departed from the compressor 11 enters the condenser 30 in the direction indicated by the solid lines and arrows, and changes into liquid in the condenser 30. The refrigerant thus liquefied moves into the heat transfer tube 21 through the valve 14, the receiver 24, the drier 25, the sub-cooler 26, the flow meter 27, the expansion valve 28, and the valve 18. Thereafter, the refrigerant passes through the interior of the heat transfer tube 21 and returns to the compressor 11 through the valve 16, and the evaporator 20.

The performance-measuring region 20 has a duplex tube structure wherein the refrigerant flows inside the heat transfer tube 21, while low-temperature warm water supplied from a low-temperature warm water supply 23 flows outside the heat transfer tube 21 through an inlet 22 and an outlet 22. The measuring conditions are shown in Table 1.

TABLE 1

| Evaporation Test | | Condensation Test | |
|---|---|---|---|
| Evaporation Temp. (at outlet) | 5° C. | Condensation Temp. (at inlet) | 40° C. |
| Quality | 0.2 | Degree of Supercooling | 5° C. |
| Degree of Superheat | 5° C. | Degree of Superheat | 30° C. |
| Temp. of Warm Water at Inlet | 15° C. | Temp. of Cooling Water at Inlet | 25° C. |
| Length of Heat Transfer Tube | | 1 m × 5 | |
| Refrigerant | | R407C | |

Heat transfer performance of the heat transfer tube is evaluated from the temperature and flow rate at the inlet/outlet 22 for low-temperature warm water, the flow rate of the refrigerant as well as the temperature and the pressure of the refrigerant at the inlet/outlet 22 for the refrigerant under the conditions shown in Table 1 wherein R407C was used.

The heat transfer performance of the above described heat transfer tubes with variation in notch was evaluated at 30 kg/hr by the use of the heat transfer-measuring system 10 described above. An example of the results evaluated is shown in FIG. 5.

Figure 5:
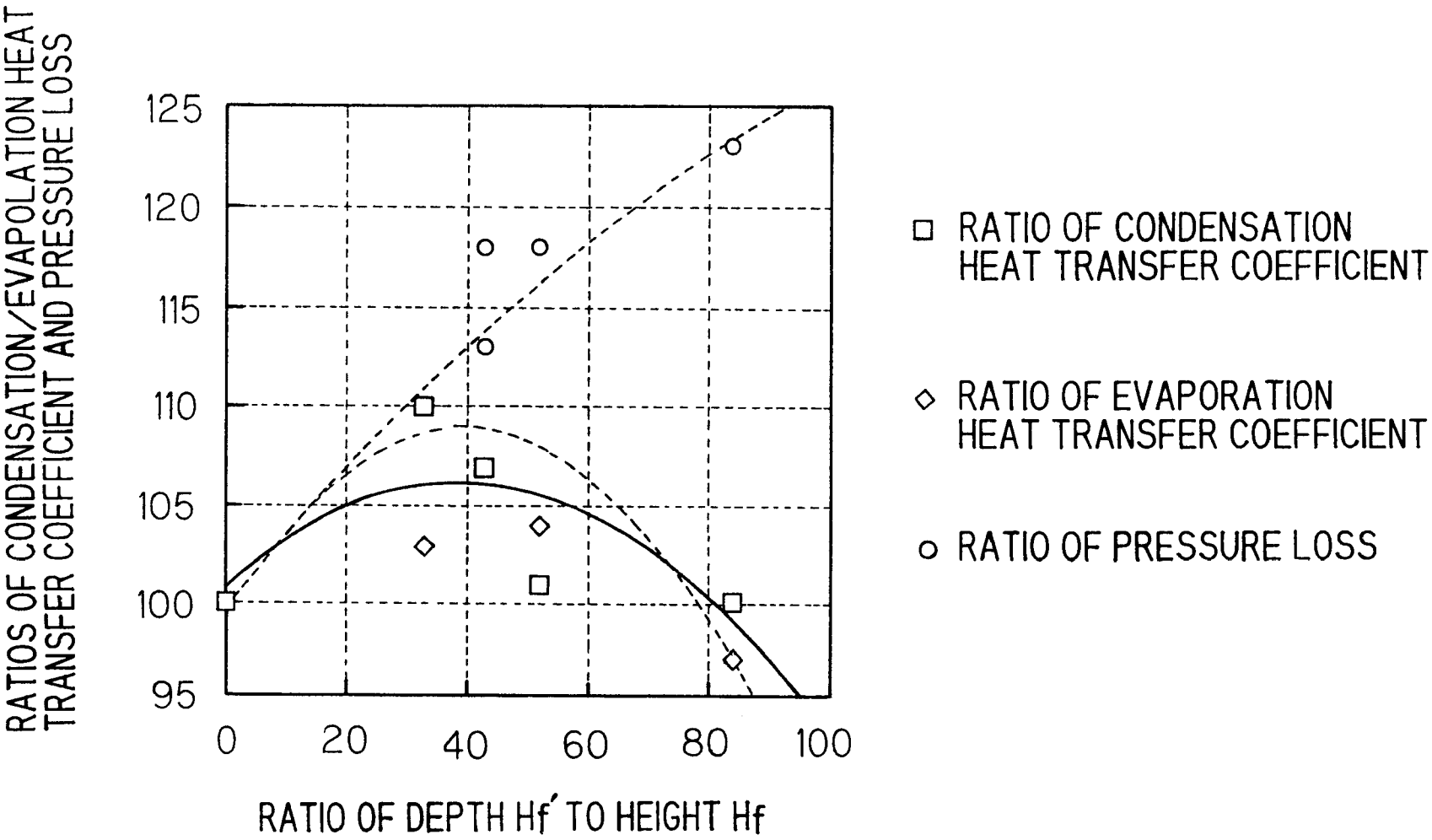
FIG. 5 is a graphical representation showing the results of evaluation of performance.

In the graph shown in FIG. 5, the axis of the abscissa indicates a ratio Hf'/Hf for a depth Hf' of a notch defined with respect to a height Hf of fin, while the axis of the ordinate indicates the ratios of condensation heat transfer coefficient, evaporation heat transfer coefficient, and pressure loss in the case where a heat transfer tube containing no notches was used as a reference.

The results shown in FIG. 5, indicate that when the depth of notches defined reaches 40% of a height of fin, the performance of the heat transfer tube reaches the peak in terms of both condensation and evaporation, and when the depth of notch exceeds 40%, the performance decreases in both. On the other hand, pressure loss rises linearly with increase in the depth of notch, because production of burr becomes significant. A refrigerant flow through the grooves is impeded by such burr.

On the basis of the experimental results mentioned above, it has been confirmed that when the depth of notches is described as to be from 20% or more and below 40% ($0.2 \leqq Hf'/Hf < 0.4$)of the height of fins, the pressure loss in the heat transfer tube can be kept to a low level while maintaining good performance in both evaporation and condensation.

Furthermore, it is to be noted that a heat transfer tube manufactured in accordance with the invention exhibited in a trial exhibited the same tendency as that shown in FIG. 5 with flow rates of refrigerant other than 30 kg/hr.

The conclusion from the above is in accordance with the description of inner surface-grooved heat transfer tube as in this invention. Since the depth of notches defined on the fins in a cross grooved structure is specified to be from 20% or more and below 40% ($0.2 \leqq Hf'/Hf < 0.4$) with respect to a height of the fins, the resulting heat transfer tube exhibits good heat transfer properties in cases of both evaporation and condensation. This, plus the additional benefit of low pressure loss leads to the statement that an inner surface-grooved heat transfer tube in accordance with the present invention will contribute to elevation in performance and promote energy saving in any air conditioner in which such a heat transfer tube is employed.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. An inner surface-grooved heat transfer tube, comprising:

a plurality of fins provided on an inner surface, each of said plurality of fins having a cone angle in the range of 12 to 25 degrees and being defined at a first predetermined angle relative to a tube axis, and each adjacent two of said plurality of fins providing a primary groove, and a plurality of notches provided on said plurality of fins, each of said plurality of notches being defined at a second predetermined angle relative to said tube axis;

wherein said each of said plurality of notches has a depth equal to 20% or more and below 40% ($0.2 \leqq Hf'/Hf < 0.4$) of a height of said plurality of fins, and the ratio of a width W3 of said primary groove to the outside diameter of said tube is in the range of 0.017 to 0.049.

2. The inner surface-grooved heat transfer tube as defined in claim 1, wherein the number of said notches is from 28 to 40 per cross section of the inner surface of the tube.

3. The inner surface-grooved heat transfer tube as defined in claim 2, wherein:

said first predetermined angle for defining said plurality of fins is opposite relative to said tube axis to said second predetermined angle for defining said plurality of notches.

4. The inner surface-grooved heat transfer tube as defined in claim 2, wherein:

said each of said plurality of fins has said height of 0.18 to 0.3 mm.

5. The inner surface-grooved heat transfer tube as defined in claim 2, wherein:

said plurality of fins and notches are provided on an inner surface of a seamless tube.

6. The inner surface-grooved heat transfer tube, as defined in claim 1, wherein:

said first predetermined angle for defining said plurality of fins is opposite relative to said tube axis to said second predetermined angle for defining said plurality of notches.

7. The inner surface-grooved heat transfer tube as defined in claim 3, wherein:

said each of said plurality of fins has said height of 0.18 to 0.3 mm.

8. The inner surface-grooved heat transfer tube as defined in claim 3, wherein:

said plurality of fins and notches are provided on an inner surface of a seamless tube.

9. The inner surface-grooved heat transfer tube as defined in claim 1, wherein:

said each of said plurality of fins has said height of 0.18 to 0.3 mm.

10. The inner surface-grooved heat transfer tube as defined in claim 1, wherein:

said plurality of fins and notches are provided on an inner surface of a seamless tube.

11. An inner surface-grooved heat transfer tube, comprising:

a plurality of fins provided on an inner surface, each of said plurality of fins having a cone angle in the range of 12 to 25 degrees and being defined at a first predetermined angle relative to a tube axis, and each adjacent two of said plurality of fins providing a primary groove, and a plurality of notches provided on said plurality of fins, each of said plurality of notches being defined at a second predetermined angle relative to said tube axis;

wherein a ratio of a depth of said plurality of notches relative to a height of said plurality of fins is set such that ratios of condensation and evaporation are both increased relative to those of an inner surface-grooved heat transfer tube having no notch, but a plurality of fins, as said ratio of a depth is increased and the ratio of a width W3 of said primary groove to the outside diameter of said tube is in the range of 0.017 to 0.049.

* * * * *